US006031446A

United States Patent [19]

Prohaska et al.

[11] Patent Number: 6,031,446

[45] Date of Patent: Feb. 29, 2000

[54] COMBINATION FUSE CLIP AND LINE TERMINAL CONNECTION DEVICE

[75] Inventors: Richard D. Prohaska; Jerold Frantiza; Warren C. Sipe, all of Cleveland, Tenn.

[73] Assignee: Eaton Corporation, Cleveland, Ohio

[21] Appl. No.: 09/265,051

[22] Filed: Mar. 9, 1999

[51] Int. Cl.[7] ..... H01H 85/22; H01R 13/68; H01R 4/48

[52] U.S. Cl. ..... 337/215; 337/214; 361/626; 361/642; 439/250; 439/830

[58] Field of Search ..... 337/215, 146, 337/156, 189, 214, 216; 361/626, 642, 646, 837; 439/250, 366, 621, 830, 890

[56] References Cited

U.S. PATENT DOCUMENTS

| | | | |
|---|---|---|---|
| 1,620,814 | 3/1927 | Getchell | 337/10 |
| 1,918,525 | 7/1933 | Eckenrode et al. | 361/642 |
| 1,955,251 | 4/1934 | Ohlson | 439/807 |
| 2,458,511 | 1/1949 | Harlow | 337/9 |
| 2,617,847 | 11/1952 | Cole | 439/621 |
| 3,575,566 | 4/1971 | Rys | 200/162 |
| 3,596,026 | 7/1971 | Rys | 200/144 |
| 3,632,917 | 1/1972 | Norden . | |
| 3,760,341 | 9/1973 | Grad . | |
| 3,801,764 | 4/1974 | Rolff et al. . | |
| 3,879,589 | 4/1975 | Rys . | |
| 4,099,828 | 7/1978 | Stegmaier et al. | 339/258 F |
| 4,108,531 | 8/1978 | Reynolds | 339/258 F |
| 4,128,291 | 12/1978 | Peterson, Jr. | 339/154 A |
| 4,176,906 | 12/1979 | Urani | 339/258 F |
| 4,302,643 | 11/1981 | Cox et al. . | |
| 4,401,863 | 8/1983 | Lemmer . | |
| 4,451,109 | 5/1984 | Inoue | 339/258 S |
| 4,547,036 | 10/1985 | Keglewitsch et al. | 339/186 R |
| 5,034,620 | 7/1991 | Cameron . | |
| 5,120,617 | 6/1992 | Cameron . | |
| 5,295,849 | 3/1994 | Jeffcoat et al. | 439/266 |
| 5,406,449 | 4/1995 | Hicks et al. . | |
| 5,434,376 | 7/1995 | Hyatt et al. | 200/293 |

FOREIGN PATENT DOCUMENTS

| | | | |
|---|---|---|---|
| 35 24 813 | 5/1987 | Germany . | |
| 4008869A1 | 9/1991 | Germany | H01H 85/153 |
| 407169357A | 7/1995 | Japan | H01H 9/10 |
| 410074425A | 3/1998 | Japan | H01H 9/10 |

OTHER PUBLICATIONS

General Electric General Duty Safety Switch, Single Throw (Guideform Specification with Picture).

*Primary Examiner*—Leo P. Picard
*Assistant Examiner*—Anatoly Vortman
*Attorney, Agent, or Firm*—Martin J. Moran

[57] ABSTRACT

A single piece fuse clip and switch blade contact receptacle is provided for use with an electrical switch, which may be a safety switch. The present invention provides an apparatus which eliminates the need for multiple connections, and which consolidates a switch blade receptacle portion with a fuse clip section in a single piece device employed in an electrical switching environment.

11 Claims, 3 Drawing Sheets

COMBINATION FUSE CLIP AND LINE TERMINAL CONNECTION DEVICE

BACKGROUND OF THE INVENTION

1. Field of the Invention

The present invention generally relates to electrical switching apparatus. The present invention more specifically relates to an apparatus for establishing an electrical connection between a line contact and a fuse contact in an electrical switching apparatus.

2. Description of the Prior Art

Apparatus and methods for transferring electrical energy from a line terminal through a fuse to a load circuit have been known in the art.

In U.S. Pat. No. 3,879,589, for example, a safety switch is taught which includes a pair of combination fuse clip and load terminal members, a pair of combination fuse clip and blade mounting members, and a pair of combination line terminal and stationary contact jaw members. In this patent the connection from line terminal through a fuse to a load is provided by a multi-connection arrangement which requires several pieces and mechanical connections to transfer electrical energy.

In another conventional safety switch application, an apparatus is provided with a fuse receiving portion which extends to contact a switch blade when the safety switch is actuated into the "on" position. This application includes a U-shaped clip suitable for receiving a fuse. The blade of this application bears against the outside surface of its fuse clip to provide electrical continuity when the switch is in the closed circuit position. However, the fuse clip in this application requires a spring on its blade assembly to bias its blade into contact with the fuse clip.

A problem not addressed in the art, however, is how to provide electrical continuity between line and load terminals in an electrical switching environment without requiring multiple additional connections along the circuit. Another problem not addressed in the art is how to maintain a switch blade securely in its actuated "on" position to ensure electrical contact between the fuse contact and the blade receptacle of an electrical switching apparatus.

Hence, there is unsatisfied need for a single piece fuse clip and switch blade receptacle apparatus and associated method which will alleviate the foregoing problems encountered in the prior art. What is needed then is an apparatus which will combine, in a single-piece device, a fuse clip portion for receiving a fuse in an electrical switching environment and a switch blade receptacle for adequately maintaining and securing a switch blade actuated in the "on" position within an electrical switching environment.

A single-piece device is needed which can be readily installed and removed from its electrical switching environment. Conventional switching technology requires multiple-piece structures which increase the cost of providing an electrical connection. A single-piece device is also needed to minimize the number of connections to improve the current carrying capacity through a circuit between a line terminal and a load terminal. Additionally, a single-piece device reduces the amount of ohmic losses which can occur at the junction of two pieces in a multiple-piece structure.

Thus in spite of existing electrical switching technology, there remains a real and substantial need for a combination fuse and contact switch which will minimize the problems associated with conventional electrical switching design and its resultant functionality.

SUMMARY OF THE INVENTION

The fuse clip and switch blade contact receptacle of the present invention is comprised of a single piece of material which is embodied as an elongated flat strap of electrically conductive spring material. The fuse clip and switch blade contact receptacle has a opening facing in a first direction. A second end of the single piece of material is bent to form a switch blade contact receptacle section which has a blade opening facing in a second direction. The second direction may be oriented in a direction opposite from the first direction.

In accordance with another aspect of the present invention, the single piece fuse clip and switch blade contact receptacle apparatus is employed in a switching system to transfer electrical energy from a line contact through a fuse to a load circuit by actuating a shaft having at least one switch blade mounted thereon from an "off" position to an "on" position. In this embodiment, at least one fuse clip and switch blade contact receptacle is coupled to a load circuit when the switch blades of the electrical switching apparatus are actuated in the closed circuit position.

It is an object of the present invention to provide an apparatus which will combine, in a single-piece device, a fuse clip portion for receiving a fuse in an electrical switching environment and a switch blade receptacle for adequately maintaining and securing a switch blade actuated in the "on" position within an electrical switching environment.

It is an object of the present invention to provide a single-piece device which may be readily installed and removed from its electrical switching environment.

It is an object of the present invention to reduce the cost of providing multiple connections in an electrical switching environment.

It is an object of the present invention to improve the current carrying capacity and to reduce ohmic losses through a circuit between a line terminal and a load terminal.

These and other objects of the present invention will be more fully understood from the following description of the invention on reference to the illustrations appended thereto.

DESCRIPTION OF THE PREFERRED EMBODIMENTS

Figure 1:
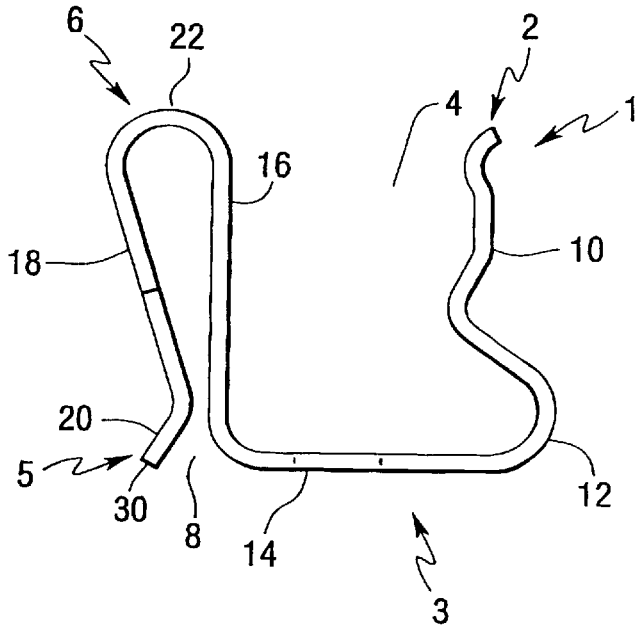
FIG. 1 is a front elevational view of the fuse clip and switch base contact receptacle.

Referring now to FIG. 1, a fuse clip and switch blade contact receptacle of the present invention is shown comprising an elongated strap 1. A first end 2 of the elongated strap 1 comprises a fuse clip section 3 having a fuse opening 4 defined therein. A second end 5 of the elongated strap 1 is bent to form a switch blade contact receptacle section 6 which includes a blade opening 8 for receiving, for example, a conventional switch blade (not shown) actuated in its closed circuit position. The fuse clip section 3 may further comprise an outer leg 10 which extends to form a fuse bight 12 which further extends to an inner leg 14 of the fuse clip section 3. The inner leg 14 of the fuse clip section 3 further extends to a common center section 16 which forms a stationary member for both the switch blade contact receptacle section 6 and the fuse clip section 3. A contact finger 18 having a free end 20 is connected to the common section 16 by a blade bight 22. The free end 20 has a tip 30 extending therefrom. The tip 30 of the contact finger 18 is preferably embodied as bent in a direction away from the common center section 16.

Referring again to FIG. 1, the elongated strap 1 is preferably composed of a single piece of material which is an electrically conductive spring material. The fuse clip section 3 is preferably embodied in a generally U-shaped configuration. In addition, the common center section 16 may be provided as generally planar. The fuse clip and switch blade contact receptacle of the present invention is preferably employed in a conventional safety switch apparatus.

Figure 2:
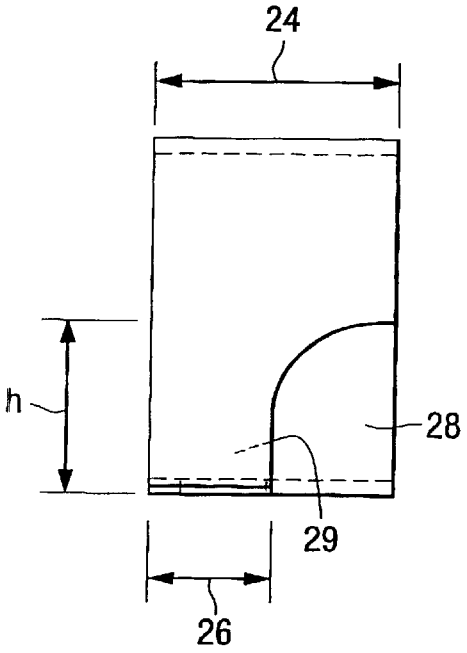
FIG. 2 is a side elevational view of the fuse clip and switch blade contact receptacle.

Referring now to FIGS. 1 and 2, in operation the blade bight 22 joins the contact finger 18 to the common center section 16, resiliently biasing the free end 20 of the contact finger 18 toward the common center section 16. Elongated strap 1 has a width 24 which is preferably larger than a width 26 of the free end 20 of the contact finger 18. An arcuate cutout 28 may be formed within the free end 20 of the contact finger 18. The arcuate cutout 28 provides an inner receptacle surface 29 having a height h which bears toward the common center section 16. The width 26 at the tip 30 is less than the width 24 for the portion of the contact finger 18 extending the height h from the free end 20 to just beyond the arcuate cutout 28 moving in a direction towards the blade bight 22. The reduced width 26 of the contact finger 18 reduces the contact pressure exerted against a switch blade (not shown) when it is initially received into blade opening 8.

Figure 3:
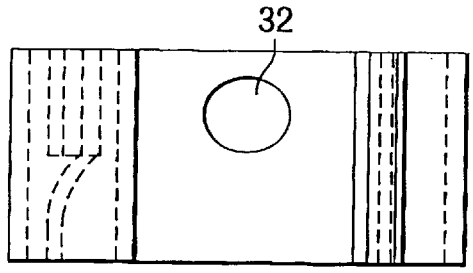
FIG. 3 is a top elevational view of the fuse clip and switch blade contact receptacle.

Referring now to FIG. 3, the inner leg 14 of the fuse clip section 2 may further have a screw hole 32 formed therein to provide for attachment of the elongated strap 1 to the insulated base (not shown) of an electrical switching apparatus, such as a switch box, for example.

Figure 4:
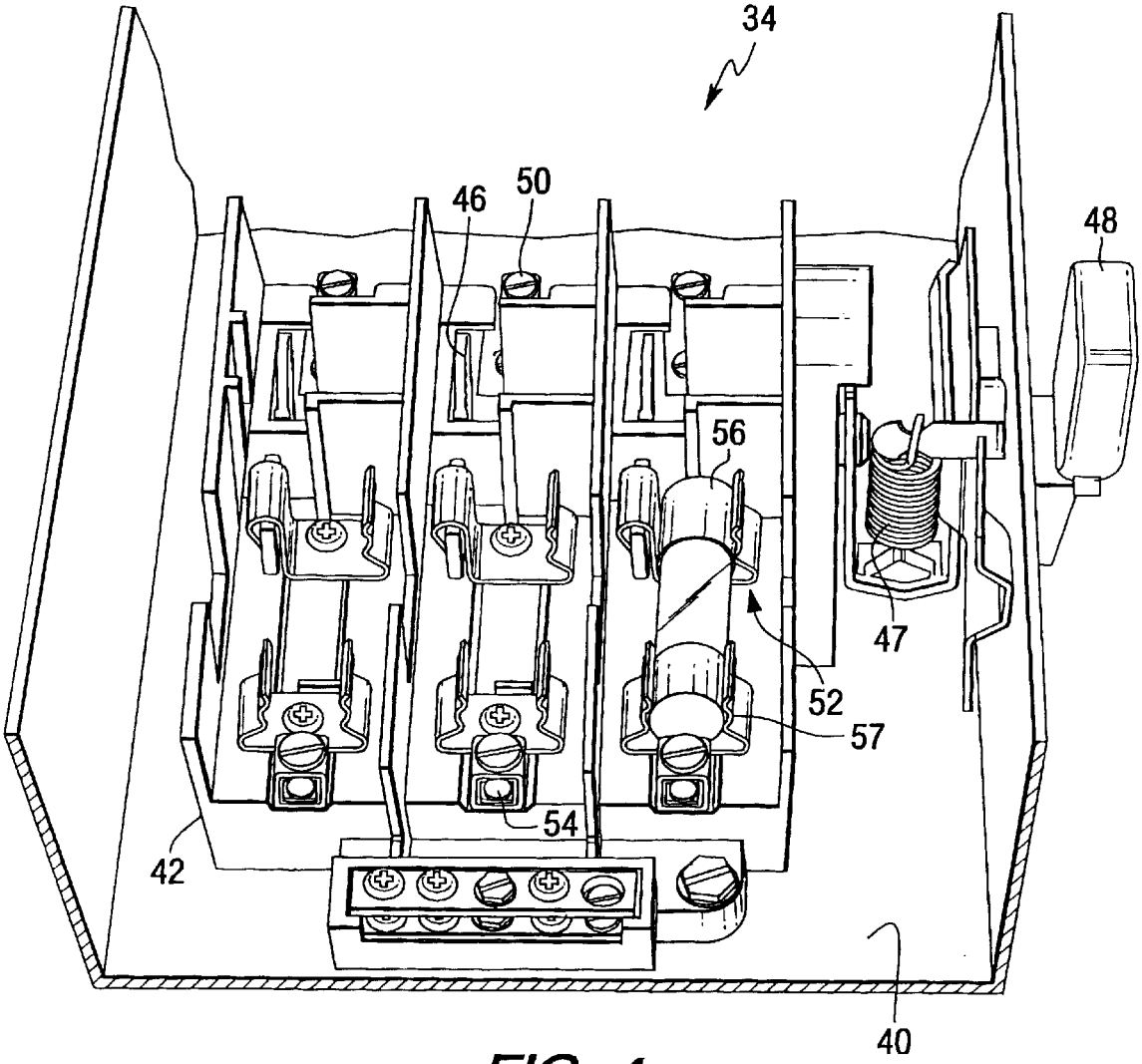
FIG. 4 is an isometric view of an electrical switching apparatus.

Referring now to FIGS. 1 and 4, a switching system 34 of the present invention may be provided with a housing 40 having an insulated base 42 secured therein. A shaft (not shown) is rotationally captive within the insulated base 42 and is connected to a snap actuating mechanism 47 and also has at least one switch blade 46 connected thereto. A handle 48 is connected to the snap actuating mechanism 47 to effect rotation of the switch blade 46 from a first closed circuit position as shown in FIG. 4 to a second open circuit position (not shown). At least one line terminal 50 is secured to the insulated base 42 which may be in alignment with at least one fuse clip and switch blade contact receptacle 52. The fuse clip section 3 of the fuse clip and switch blade contact receptacle 52 preferably faces in a first direction and the blade opening 8 preferably faces in a second direction which is opposite to the first direction. It will also be appreciated that each of the line terminals 50 is physically connected to a spring clip (not shown) or other suitable, conventional apparatus for connecting the line terminal 50 to the switch blade 46. This connection enables the line terminal 50 to be electrically coupled to the switch blade 46 when the switch blade 46 is actuated in its closed circuit position as shown in FIG. 4.

Figure 5:
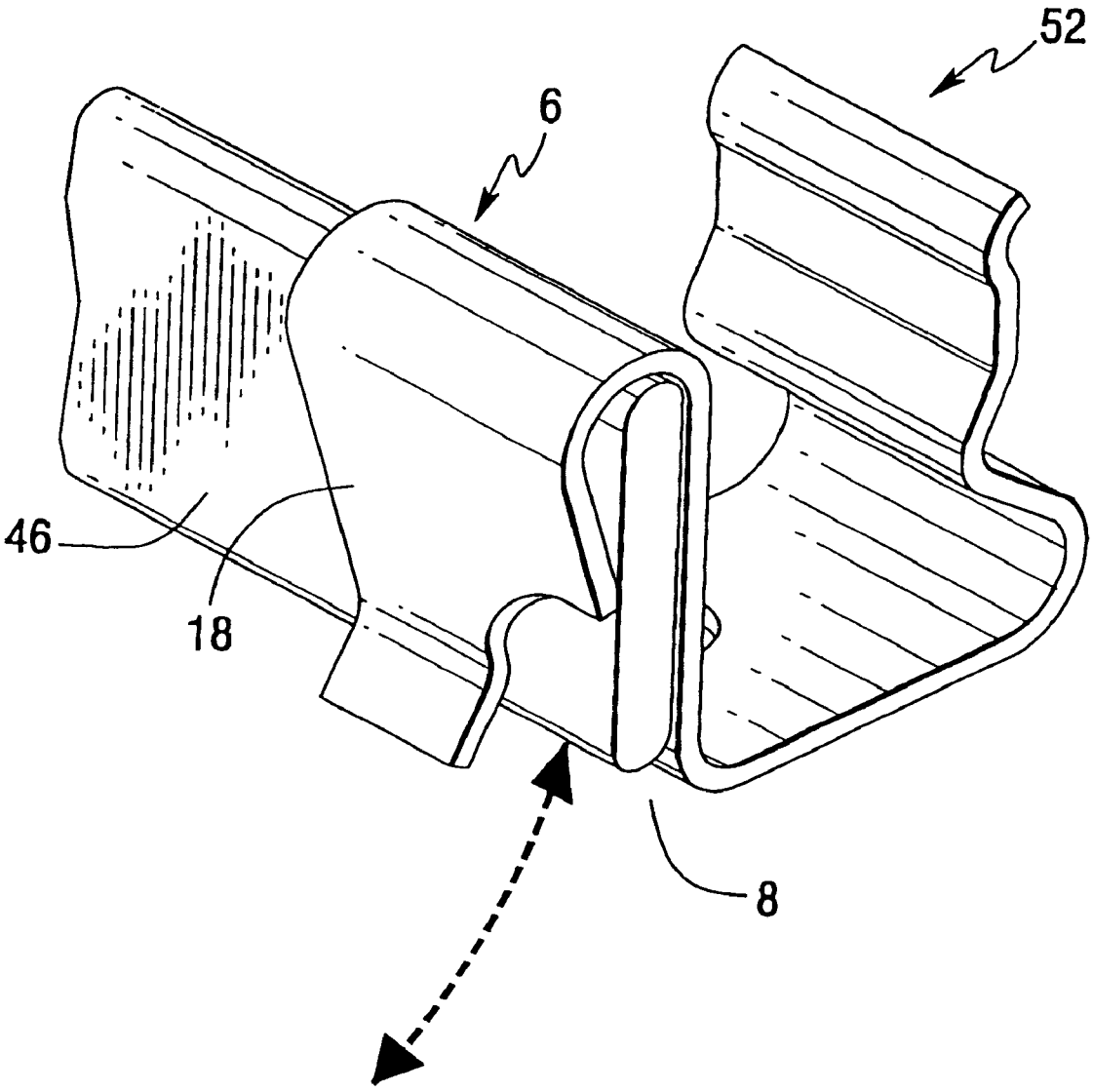
FIG. 5 is an isometric view of the fuse clip and switch blade contact receptacle having a switch blade secured therein.

Referring now to FIGS. 1, 4 and 5, in operation, when the switch blade 46 is in the closed circuit position, the switch blade 46 is received and electrically coupled to the switch blade contact receptacle section 6 as shown in FIG. 5. The fuse clip and switch blade contact receptacle 52 is indirectly electrically coupled to the line terminal 50 through the contact of the switch blade 46 with a spring clip, for example, which electrically couples the line terminal 50 to the switch blade 46 when the switch blade 46 is actuated in its closed circuit position as shown in FIG. 4. When received into the switch blade contact receptacle section 6, the switch blade 46 establishes an electrical connection between the switch blade contact receptacle 6 and the line terminal 50.

Referring now to FIGS. 1 and 4, a load terminal 54 is also mounted to the insulated base 42 in substantial alignment with the fuse clip section 3 of the fuse clip and switch blade contact receptacle 52. At least one fuse 56 is positioned to electrically couple the fuse clip section 3 to the load terminal 54 when the switch blade 46 is actuated in its closed circuit position. It will be appreciated that connection between the fuse 56 and the load terminal 54 may be accomplished by a conventional apparatus such as a spring clip 57 or another suitable apparatus for receiving and maintaining the fuse 56 therein. The spring clip 57 also electrically couples the fuse 56 with the load terminal 54 through the connection of the spring clip 57 to the load terminal 54.

Referring again to FIG. 5, the fuse clip and switch blade receptacle 52 is shown in the closed circuit position. The switch blade 46 is received into the blade opening 8 of contact finger 18 to complete an electrical circuit.

Whereas particular embodiments of the invention have been described for purposes of illustration, it will be evident to those skilled in the art that variations of the details may be made without departure from the invention as defined in the appended claims.

What is claimed is:

1. A single piece fuse clip and switch blade contact receptacle for use with a switch comprising an elongated flat strap of electrically conductive spring material having a first end bent to form a generally U-shaped fuse clip section having a fuse opening facing in a first direction and a second end bent to form a generally U-shaped switch blade contact receptacle section having a blade opening facing in a second direction, which is opposite to the first direction.

2. The fuse clip and switch blade contact receptacle of claim 1, wherein said switch is a safety switch.

3. The fuse clip and switch blade contact receptacle of claim 1, wherein said fuse clip section further comprises an outer leg extending from said first end, a fuse bight section extending from said outer leg, and an inner leg extending from said bight section.

4. The fuse clip and switch blade contact receptacle of claim 1, further comprising a common center section forming a stationary member for both said fuse clip section and said switch blade contact receptacle section.

5. The fuse clip and switch blade contact receptacle of claim 4, wherein said common center section is generally planar.

6. The fuse clip and switch blade contact receptacle of claim 4, further comprising a contact finger extending to and having a free end at said second end of said elongated strap and a base bight joining said contact finger to said stationary member and resiliently biasing said free end of said contact finger toward said stationary member.

7. The fuse clip and switch blade contact receptacle of claim 6, wherein said elongated strap has a selected width and said free end has a width less than said selected width.

8. The fuse clip and switch blade contact receptacle of claim 7, wherein said free end of said contact finger further comprises an arcuate cutout formed therein.

9. The fuse clip and switch blade contact receptacle of claim 8, wherein said contact finger has a tip at its free end bent away from said stationary member to form an inner receptacle surface bearing toward said stationary member.

10. The fuse clip and switch blade contact receptacle of claim 9, wherein a portion of said contact finger extending from said tip to beyond said arcuate cutout has a width at said tip less than said selected width.

11. An electrical switch comprising:

a housing having an insulated base secured therein;

a shaft rotationally captive within said insulated base having at least one switch blade connected thereto;

a handle connected through a snap actuating mechanism to said shaft for rotating said shaft from a first closed circuit position to a second open circuit position;

at least one line contact secured to said insulated base;

at least one single piece fuse clip and switch blade contact receptacle comprising an elongated flat strap of electrically conductive spring material having a first end bent to form a generally U-shaped fuse clip section having a fuse opening facing in a first direction and a second end bent to form a generally U-shaped switch blade contact receptacle section having a blade opening facing in a second direction, which is opposite to the first direction wherein when said shaft is in said closed circuit position said switch blade is received in and electrically coupled to said switch blade contact receptacle section and is also electrically coupled to said line contact to establish an electrical circuit between said single piece fuse clip and switch blade contact receptacle and said line contact;

at least one load terminal mounted to said insulated base in substantial alignment with said fuse clip and switch blade contact receptacle; and, at least one fuse removably positioned to electrically couple said fuse clip and switch blade contact receptacle to said fuse contact when said shaft is in said closed circuit position.

* * * * *